US008544865B1

(12) United States Patent
Janikowski

(10) Patent No.: US 8,544,865 B1
(45) Date of Patent: Oct. 1, 2013

(54) SANITARY WHEELCHAIR COVER AND DRIVE GRIP

(71) Applicant: Carla J. Janikowski, Hatley, WI (US)

(72) Inventor: Carla J. Janikowski, Hatley, WI (US)

( * ) Notice: Subject to any disclaimer, the term of this patent is extended or adjusted under 35 U.S.C. 154(b) by 0 days.

(21) Appl. No.: 13/744,926

(22) Filed: Jan. 18, 2013

(51) Int. Cl.
*A61G 5/02* (2006.01)

(52) U.S. Cl.
USPC ..... 280/250.1; 150/166; 280/304.1

(58) Field of Classification Search
USPC ..... 280/250.1, 304.1; 150/166, 154, 150/155; 74/552, 557; 301/37.101, 37.22, 301/37.31, 37.32, 37.12; 16/421, 430; 482/49
See application file for complete search history.

(56) References Cited

U.S. PATENT DOCUMENTS 2,876,486 A * 3/1959 Lindstrom ..... 16/421
3,623,748 A * 11/1971 Haynes ..... 280/202
6,241,268 B1 6/2001 Niklasson
6,276,705 B1 8/2001 Baldwin et al.
6,439,281 B1 * 8/2002 Hogg ..... 152/152
6,722,680 B2 4/2004 DeLong et al.
7,040,642 B2 5/2006 Lowry
7,234,717 B1 6/2007 Thomas
7,497,456 B2 3/2009 Willems et al.
2001/0007389 A1 * 7/2001 Frauwirth ..... 280/304.1
2002/0125711 A1 * 9/2002 Calhoun ..... 280/848

FOREIGN PATENT DOCUMENTS

JP 2013-13698 * 1/2013

* cited by examiner

*Primary Examiner* — Anne Marie M Boehler
(74) *Attorney, Agent, or Firm* — Andrus, Sceales, Starke & Sawall, LLP

(57) ABSTRACT

A wheelchair propulsion and contamination reduction arrangement permits the user to drive the chair on the main ground-engaging rear wheels with a compressible wheel cover that is grasped and squeezed against the wheel to provide propulsion and mounted with elastic tension devices on opposite ends that return the drive grip to a neutral position when the user relaxes the compression. The compressible device is a polymeric foam which can also be adapted to carry one or more of a lubricant, cleaner and biostatic treatment.

15 Claims, 3 Drawing Sheets

FIG. 4
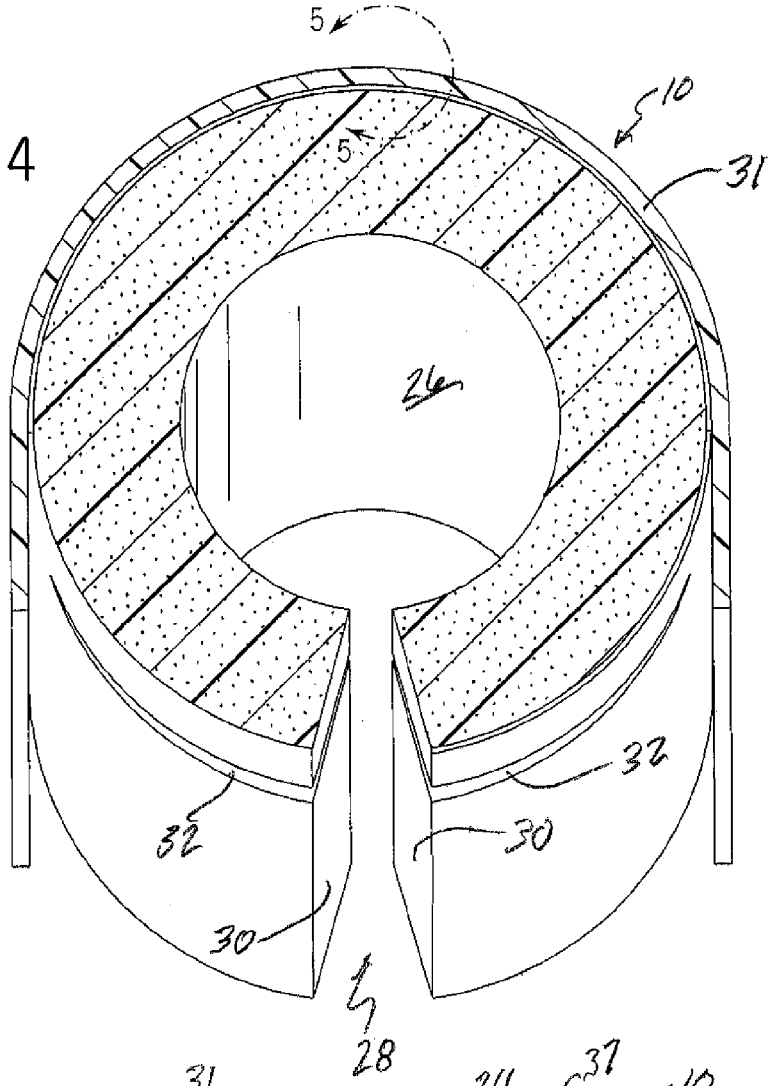
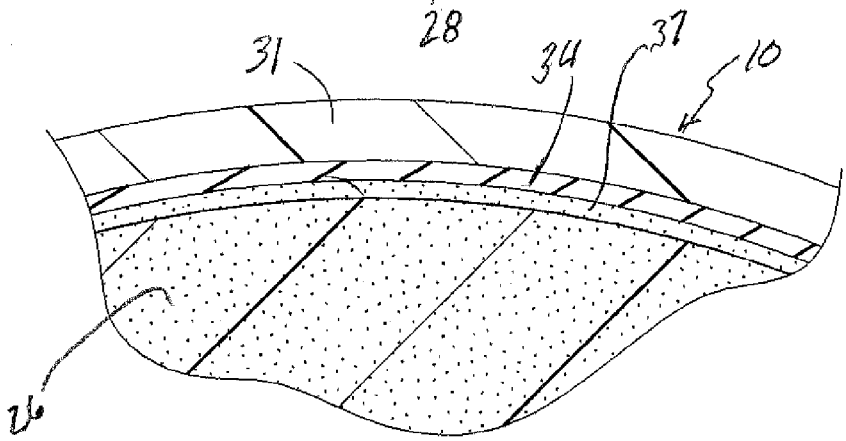
FIG. 5

SANITARY WHEELCHAIR COVER AND DRIVE GRIP

BACKGROUND

The present invention relates to an apparatus for facilitating operator use of a wheelchair in a sanitary manner that inhibits the transfer of contaminants from the wheel to the user and also prevents the buildup of such contaminants on the wheel surface.

Certain governmental agencies, such as the Occupational Safety and Health Administration (OSHA), the Center for Disease Control and Prevention (CDC) and similar state agencies and authorities issue and enforce standards for minimizing contamination of appliances, articles and various other devices that are touched and used by residents and/or patients in hospitals, assisted living facilities, and nursing homes. Responsible agencies, authorities and administrations promulgate, monitor and enforce regulations to inhibit the propagation of contaminants on appliances that may carry bacteria, viruses and other disease carrying contaminants. Rules and regulations to minimize the transfer of such diseases address all types of apparatus and appliances that are routinely touched by patients, residents, healthcare providers and other workers.

One device that is particularly problematic and well known to be the source of many kinds of contaminants is the ubiquitous wheelchair found and used in all the aforementioned facilities. A conventional wheelchair has two main large diameter rear wheels to which are attached concentric smaller diameter push or drive wheels. The user grasps the smaller diameter concentric wheel to drive the wheelchair and to avoid user contact with the large diameter floor-engaging rear wheels. Regulations typically require periodic cleaning of the main rear wheels, but, as is apparent, freshly cleaned rear wheels will quickly become contaminated. A user utilizing the push ring oftentimes contacts the large diameter wheel with the user's wrists as the push wheel is propelled by the user.

SUMMARY

The present invention provides a sanitary wheel cover and a drive grip that permits the user to drive the wheelchair by the large floor-engaging rear wheel without direct contact therewith. The drive grip can be grasped by the user and flexed to compress a compressible portion against a portion of the outer rim of the main wheel to alternately propel the wheelchair in a forward direction (or similarly the rear direction) and then release the grip for return to a neutral position under the influence of an elastic strap that connects each end of the drive grip for the respective front and rear of the wheelchair frame. The apparatus of the present invention may be used without the need for a conventional push rim because the user's hands grasp the drive grip and large wheel to provide propulsion.

The sanitary wheelchair cover and drive grip of the present invention is intended primarily for use on a wheelchair of the type that has a user supporting frame, a pair of large diameter rear wheels carried on the frame and engageable by the user to propel the chair. The apparatus of the present invention facilitates user propulsion without contamination of the user's hands from material picked up in use and carried on the outer surface of the rear wheels.

A semi-circumferential drive grip 19 is demountably attached to a tire on the large outer rim of each rear wheel. The drive grip includes a manually compressible portion that is in direct contact with the outer rim and a flexible grip cover that overlies the compressible portion of the grip. An elastic strip connects each end of the drive grip to the respective front and rear of the wheelchair frame to hold the grip in a neutral position. The user is able to grasp the grip and compress the compressible portion against the tire on the outer rim and push the main drive wheel forwardly. This movement increases the length of and tension in the rear strap and provides rolling movement of the wheel. Releasing the grip by the user reduces the compression to permit higher tension in the rear strap to return the grip to the neutral position. Rearward movement of the wheelchair is accomplished in a similar manner.

The manually compressible portion of the drive grip preferably comprises a tubular piece of polymeric foam that is curved to adapt the tubular piece to the curvature of the wheel. The flexible grip cover preferably comprises a U-shaped plastic piece that overlies the tubular foam piece. In one embodiment, the U-shaped plastic piece is fastened to the tubular foam piece. The plastic piece may be fastened to the tubular piece with an adhesive, a hook-and-loop fastener, or some other suitable connecting device.

The radially outer surface of the flexible plastic piece preferably has an outer grip-enhancing texture or similar surface treatment. The elastic strip extends through slots in the respective front and rear ends of the grip cover. The elastic straps may comprise separate straps, but, preferably, the elastic straps are one-piece. Each elastic strip is demountably attached at opposite strap ends to the wheelchair frame.

The interior surface of the tubular foam piece may be provided with one or more layers or coating of a material that is selected from the group consisting of a lubricant, a cleaner and a biocide. The lubricant coating facilitates sliding movement of the tubular piece relative to the wheel rim when not being compressed and propelled. The coating of a cleaner and/or a biostatic provides protection against contamination of the user's hands and anyone or anything else that might come into contact with a user. The tubular foam piece may be detachable from the grip cover for disposal and replacement. Preferably, the tubular foam piece is cut from a spirally wound supply to more easily adapt to the curvature of the wheelchair drive wheels. Further, the tubular foam piece is preferably formed with a slit along its length providing a C-shaped tubular piece having oppositely facing lengthwise edges. If the foam piece is not pre-formed with a curvature, the lengthwise edges of the C-shaped tubular piece can be provided with V-shaped slots to accommodate bending of a straight tubular piece to the desired curved shape.

In a related method for facilitating sanitary use and propulsion of a wheelchair by a user, the wheelchair having a frame and a pair of large diameter rear wheels carried on the frame and engageable for propulsion by the user, the method comprises the steps of (1) mounting a semi-circumferential drive grip to an outer portion of a tire on the rim of each rear wheel, (2) providing the drive grip with a tubular piece of polymeric foam in contact with the tire on the wheel outer rim, (3) providing the drive grip with a flexible grip cover that overlies the compressible tubular foam piece, (4) attaching the grip cover to the tubular foam piece, and (5) connecting the opposite circumferential ends of the drive grip to the front and rear of the wheelchair frame with respective front and rear elastic members, whereby the drive grip is initially held in a static neutral position by the elastic members. Manual engagement of the drive grip with squeezing and pushing action by the user causes the compressible tubular foam piece to clamp the wheel, and causes the wheel and chair to move forwardly without direct contacting touch of the wheel by the user.

BRIEF DESCRIPTION OF THE DRAWINGS

FIG. 4 is an isometric sectional view taken on line 4-4 of FIG. 3.

FIG. 5 is an enlarged detail taken on line 5-5 of FIG. 4.

DETAILED DESCRIPTION

Figure 1:
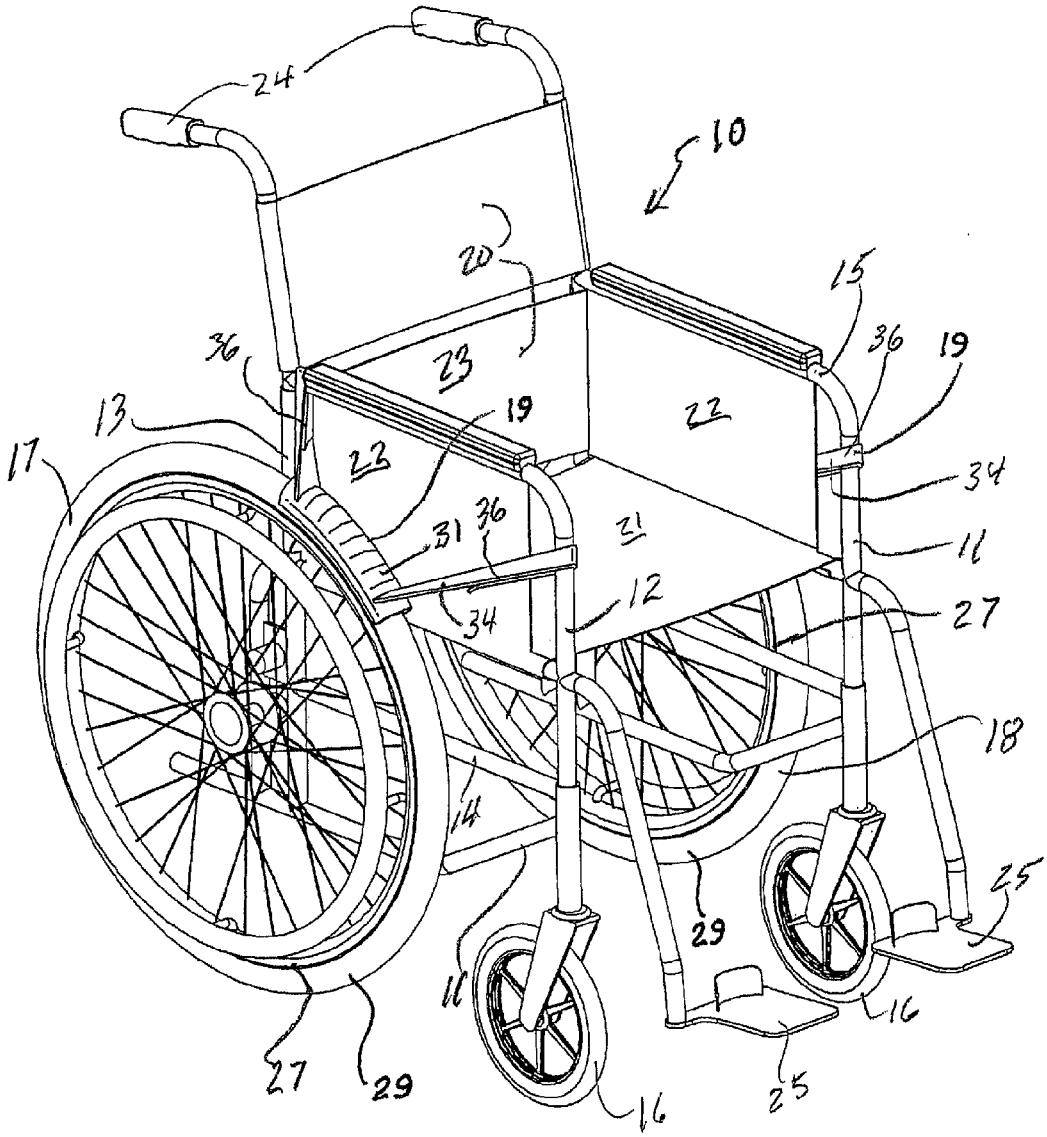
FIG. 1 is a perspective view of a prior art wheelchair to which is attached the sanitary wheel cover and drive grip of the present invention.

In FIG. 1, there is shown a conventional wheelchair 10 having a general construction well known in the art. A frame 11 provides support for the seated user and includes front and rear frame members 12 and 13 that are interconnected with side frame members 14 and 15. The front frame member includes a connection at the lower end to a pair of castered support wheels 16. A pair of large diameter drive wheels 17 and 18 are carried by the side frame members 14 and 15. To support the user, flexible cloth or cloth-like panels are attached to the frame 11 and include a seat panel 21, a pair of side panels 22, and a pair of generally vertically aligned back panels 23, all in a manner well known in the art. The upper ends of the rear frame member 13 includes push arms 24 to provide assistance to the user and a pair of front foot supports 25 that are typically pivotable to swing away or are completely detachable.

Figure 2:
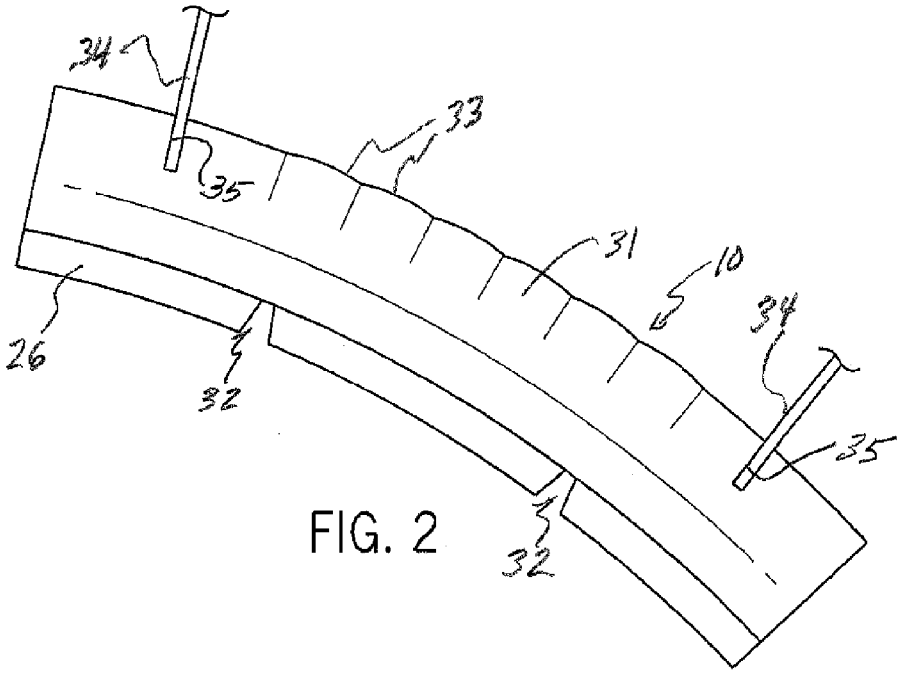
FIG. 2 is an enlarged side elevation view of the sanitary wheel cover and drive grip of the present invention.
Figure 3:
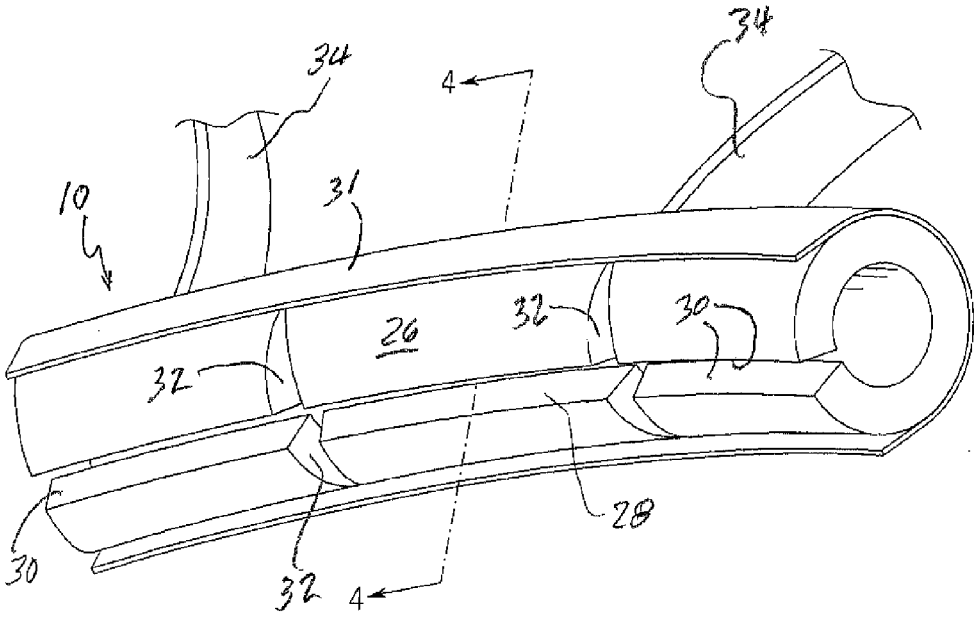
FIG. 3 is a bottom plan view of the cover and drive grip shown in FIG. 2.

In FIG. 1, the sanitary wheel cover and grip 19 of the present invention is shown attached to the wheelchair W and, in FIGS. 2 and 3, the sanitary wheel cover and grip 19 is shown enlarged and detached from the wheelchair W. The cover and grip 19 includes a tubular semi-circumferential piece of polymeric foam 26 that, in use, is attached to a tire 29 on the rim 27 of the drive wheel 17, 18. The tubular foam piece 26 has a longitudinal slit 28 that defines oppositely facing lengthwise edges 30. The slit 28 facilitates attachment of the cover and grip 19 to the rims and tires 29 of the drive wheels 17, 18, and also adapts the device to varying rim sizes.

The polymeric foam from which the tubular piece is made may vary considerably, but a closed cell polyurethane foam has been found to be suitable. Other foam materials of both open and closed cell construction may also be used.

A flexible grip cover 31 overlies and partially covers the tubular foam piece 26. The grip cover may be formed to the curvature of the drive wheels 17 and 18 or may be sufficiently flexible to bend to the desired curvature. Any relatively hard, but flexible plastic may be used. However, if the tubular foam piece is cut from straight tubular stock, the tubular pieces may be formed with V-shaped slots 32 spaced along the edges 30 of the longitudinal slit 28. The flexible grip cover 31 is preferably of a generally U-shape and has an outer grip-enhancing texture 33 or similar surface treatment to minimize slippage of the user's hands on the cover.

Although the grip cover 31 may be adhesively attached to the tubular foam piece to provide a desired permanent connection, allowing the integral cover 31 and foam piece 26 to be disposable, the foam piece 26 may be removable or demountable for replacement. If the foam piece is intended to be removable from the grip cover 31, the pieces may be fastened together with an easily removable adhesive, a hook-and-loop fastener, or some other suitable connecting device.

An elastic strip 34 connects each end of the grip cover 31 to a front frame member 12 and a rear frame member 13. The elastic strip 34 may comprise a single piece of elastic or two separate strip pieces. In the embodiment shown, the elastic strip 34 is unitary. The strip is attached to the grip cover 31 by running opposite ends of the strip through front and rear strip slits 35 in the cover where the center of the elastic strip may be held in place with the same adhesive used to attach the grip cover 31 to the tubular foam piece 26. The opposite front and rear free ends of the elastic strip 34 may be conveniently wrapped around any suitable portion of the side frame members 14 and 15, stretched to provide tension in the strip, and brought back on itself and fixed in position with a hook-and-loop fastener 36. With both ends of the elastic strip 34 attached and tensioned as indicated, the drive grip 19 is held in a neutral position as shown in FIG. 1.

When a user seated on the wheelchair 10 grasps the grip cover 31 of the drive grip 19, the grip is easily slid along the tire 29 and rim 27 of the drive wheel 17, but if the user squeezes the drive grip, a gripping force is applied to the tire and rim to cause the wheelchair to be propelled forwardly. The forward movement of the drive grip simultaneously causes the front end of the elastic strip 34 to contract and to decrease the tension therein. At the end of forward movement of the drive grip, the user releases the compression and the rear end of the elastic strip 34, having been lengthened and further tensioned by the drive grip, will cause the drive grip to slide rearwardly to the neutral position of the grip.

If necessary, the ID of the tubular foam piece 26 may be lubricated by applying a thin coating of a suitable lubricant thereto. In addition, the ID of the foam piece 26 may also be provided with a biostatic coating and/or a suitable cleaner. In this manner, the sanitary wheel cover and drive grip 19 of the present invention minimizes user contact with the tires 29 and rims 27, helps keep the device clean and may provide a suitable decontaminant. The conventional wheelchair push wheels or rims may be eliminated.

What is claimed is:

1. In a wheelchair having a user supporting frame, a pair of rear wheels carried on the frame and engageable by the user to propel the chair, an apparatus for facilitating user propulsion without contamination of the user's hands from material picked up in use and carried on the outer surface of the rear wheels, the apparatus comprising:

a semi-circumferential drive grip demountably attached to a tire of each rear wheel, the grip including a manually compressible portion in direct contact with the tire and a flexible grip cover overlying the compressible portion, an elastic strap connecting each end of the drive grip to the respective front and rear of the frame to hold the grip in a neutral position, such that the user is able to alternately grasp the grip and compress the compressible portion against the tire and push the wheel forward to increase the length and tension in the rear strap to provide rolling movement of the wheel, and to reduce the compression to permit tension in the rear strap to release the grip from rolling movement with the wheel and to return the grip to the neutral position.

2. The apparatus as set forth in claim 1, wherein the manually compressible portion of the drive grip comprises a tubular piece of polymeric foam curved to adapt to the curvature of the wheel.

3. The apparatus as set forth in claim 2, wherein the flexible grip cover of the drive grip comprises a U-shaped plastic piece overlying the tubular foam piece.

4. The apparatus as set forth in claim 3, wherein the U-shaped plastic piece is fastened to the tubular foam piece.

5. The apparatus as set forth in claim 4, wherein the plastic piece is fastened to the tubular piece with an adhesive.

6. The apparatus as set forth in claim 4, wherein the plastic piece is fastened to the tubular piece with a hook-and-loop fastener.

7. The apparatus as set forth in claim 1, wherein the radially outer surface of the flexible plastic piece has a grip-enhancing texture.

8. The apparatus as set forth in claim 1, wherein the elastic strap extends through slots in the respective front and rear ends of the grip cover.

9. The apparatus as set forth in claim 8, wherein the elastic straps comprise a one-piece elastic strap.

10. The apparatus as set forth in claim 9 wherein the elastic strap is demountably attached at opposite strap ends to the frame.

11. The apparatus as set forth in claim 2, wherein the interior surface of the tubular foam piece is provided with a coating of a material selected from the group consisting of a lubricant, a cleanser and a biocide.

12. The apparatus as set forth in claim 11, wherein the tubular foam piece is disposable.

13. The apparatus as set forth in claim 2 wherein the tubular foam piece is demountably attached to the flexible grip cover.

14. The apparatus as set forth in claim 2, wherein the tubular foam piece is formed from a straight C-shaped tubular piece having oppositely facing lengthwise edges provided with V-shaped slots to accommodate bending of the straight tubular piece to a curved shape.

15. A method for facilitating sanitary use and propulsion of a wheelchair by a user, the wheelchair having a chair frame and a pair of rear wheels each having a rim and tire carried on the frame and engageable for propulsion by the user, the method comprising the steps of:

(1) mounting a semi-circumferential drive grip to an outer portion of the tire of each rear wheel;

(2) providing the drive grip with a tubular piece of polymeric foam in contact with the tire;

(3) providing the drive grip with a flexible grip cover overlying the compressible tubular foam piece;

(4) attaching the grip cover to the tubular foam piece; and (5) connecting the opposite circumferential ends of the drive grip to the front and rear of the wheelchair frame with respective front and rear elastic members;

whereby the drive grip is initially held in a neutral position by the elastic members and, when the drive grip is engaged, squeezed and pushed by the user, the compressible tubular foam piece clamps the tire, causing the wheel and chair to move forwardly and the user need not touch the tire.

* * * * *